US005184547A

United States Patent [19]

Bergmann

[11] Patent Number: 5,184,547

[45] Date of Patent: Feb. 9, 1993

[54] EQUIPMENT FOR COMPACTING COMPRESSIBLE WASTES

[76] Inventor: Heinz Bergmann, Im Runderdiek 1, 4474 Lathen, Fed. Rep. of Germany

[21] Appl. No.: 691,303

[22] Filed: Apr. 25, 1991

[30] Foreign Application Priority Data

Apr. 25, 1990 [DE] Fed. Rep. of Germany ..... 4013134

[51] Int. Cl.[5] ..... B30B 15/14; B30B 5/00

[52] U.S. Cl. ..... 100/50; 53/530; 100/99; 100/178; 100/292; 141/81

[58] Field of Search ..... 100/50, 99, 177, 178, 100/292, 906, 907; 141/71, 81, 258; 53/529, 530

[56] References Cited

U.S. PATENT DOCUMENTS

| | | | |
|---|---|---|---|
| 531,058 | 12/1894 | Ollagnier | 100/50 |
| 709,793 | 9/1902 | McGinnity | 100/907 X |
| 1,788,330 | 1/1931 | Ross | 100/907 X |
| 2,683,932 | 7/1954 | Steenhuis | 100/906 X |
| 3,070,002 | 12/1962 | Mathews | 100/177 X |
| 3,593,656 | 7/1971 | Churchman et al. | 100/177 |

FOREIGN PATENT DOCUMENTS

| | | | |
|---|---|---|---|
| 1461982 | 3/1969 | Fed. Rep. of Germany | 141/81 |
| 2926161 | 1/1981 | Fed. Rep. of Germany | 53/530 |
| 53822 | 1/1943 | Netherlands | 100/177 |
| 1373356 | 2/1988 | U.S.S.R. | 100/906 |

*Primary Examiner*—Harvey C. Hornsby
*Assistant Examiner*—Stephen F. Gerrity
*Attorney, Agent, or Firm*—Longacre & White

[57] ABSTRACT

The invention concerns equipment for compacting compressible wastes such as paperboard, cardboard, wood wastes, household trash or the like and is designed in such a way to include a rotating drum and plunger combination so that the trash is moved at equal spacings through a segmented housing and into a receptacle or the like. During conveyance the conveyed trash does not give off foul odors.

24 Claims, 3 Drawing Sheets

EQUIPMENT FOR COMPACTING COMPRESSIBLE WASTES

BACKGROUND OF THE INVENTION

1. Field of the Invention

The invention concerns equipment for compacting compressible wastes such as paperboard, cardboard, wood wastes, and household trash. The machine is comprised of a rotatably driven drum inside a housing with an approximately vertical duct for material intake and discharge.

2. Description of the Prior Art

Some current waste compactors rely upon a roller revolving and resting on top of the waste, weighing down the waste. In these compactors, the waste is merely friction loaded by the roller. Moreover, the trash being compacted is exposed to the ambient air during conveyance.

With other waste compactors, trash being compacted is moved through a shaft or the like in front of the conveyance surface of a pressure plunger which when actuated compresses the trash and in some cases moves it into a container. Such a system may also be mounted vertically so that the wastes to be compacted can be moved underneath the compression surface of the plunger. In the latter case the wastes can be moved simultaneously into a receptacle, a bag or the like.

These trash compactors suffer from the drawback that either the trash is exposed to the ambient air during conveyance and that this conveyance proceeds only by frictionally loading this trash. In the case of compression-plunger designs, it is difficult to move the wastes in sufficient quantities to or below the compression surface. As with the other trash compactors with the compression-plunger design, the trash is exposed to the ambient air during conveyance, with possible odor pollution.

SUMMARY OF THE INVENTION

In the present invention, trash is transported at specific and uniform distances apart into a receiving container without giving off offensive odors during conveyance.

This trash compactor is comprised of a rotatably driven, cylindrical drum inside a housing with an approximately vertical duct for material intake and material discharge. The drum is comprised of a cross-sectionally square or rectangular shaft symmetrical relative to the drum. The vertical duct passes through the drum from its outside surface and serves to receive a cross-sectionally matching compacting plunger. The plunger is comprised of two partly cylindrical mutually opposite peripheral surfaces of which the radii correspond to the drum radius and the distance between these outer peripheral surfaces is less than the diameter of the drum. Two planar surfaces are located between the outer surfaces of the plunger. The compacting plunger is further comprised of an elongated-slot slanting relative to the shaft and in a plane perpendicular to the drum axis. The ends of this guide point to the connecting edges which are rearward as seen in the direction of rotation of the drum and which are located between the partly cylindrical and the planar outer surfaces of the drum. A stationary pin is positioned in the guide, the axis of which is located in the vertical mid-plane through the drum and of which the outside diameter corresponds to the distance between the two straight surfaces of the guide, the pin being mounted below the horizontal mid-plane through the drum and offset in the direction of the discharge duct.

This design makes it possible to move the plunger to-and-fro by means of the pin connection and through the pin's guide below the particular lower part of the shaft when the drum drive rotates the drum. Because the pin is downwardly offset, a receiving chamber for the trash to be compacted remains open at the upper end of the shaft away from the pin. The size of this chamber decreases when the drum rotates, whereby pre-compaction of the trash takes place by means of the housing wall facing the drum only when the drum is rotating. As the drum continues to rotate, it pushes the plunger further against the trash to be compacted and simultaneously forces it into the discharge duct mounted underneath the shaft. This discharge duct may lead into a receptacle.

On account of the geometry of shaft and plunger, the outside surfaces of the plunger during this last compaction position moves together with the drum along a wiper edge mounted on the exit of the discharge duct, whereby any trash adhering to the plunger shall be wiped off and moved into the receptacle.

During compaction, the trash is always sealed from the ambient air both in the receiving chamber of the plunger shaft and in the receptacle, so that clean conveyance of the trash without odor pollution or the like is assured.

Appropriately, the drum is supported between two walls perpendicular to its axis. These walls also hold the pin in a stationary manner. As a result, the plunger motion is constrained by the pin and its guide. The larger the plunger stroke is, the greater the pin offset from the center of the plane of the drum axis toward the receptacle will be.

The magnitude of the plunger stroke is limited by the peripheral geometry of the plunger because its cylindrical outer surfaces in their extreme outer position must complement the drum cross-section. If in any position the plunger or the outer surfaces were to project beyond the drum circumference, then the drum would jam, and the machine would malfunction.

If the plunger strokes are too small, the outer surface of the plunger, in its discharge position relative to the receptacle, would not reach the outer surfaces of the drum. Consequently, residual trash adhering to the plunger would not be effectively swept of by the wiper edge.

To avoid this problem, the pin diameter shall be as large as the distance between the inside surface of the elongated-slot guide facing one of the cylindrical outside surfaces and the tangent parallel to the outside surface. Accordingly, the pin diameter shall be as large as possible to minimize the loads on this equipment component.

Furthermore, the shaft width shall correspond approximately to the shaft length in the vicinity of the cylindrical walls. The shaft may have a rectangular cross section.

Accordingly, the plunger is guided by the plane, smoothed surface inside the drum shaft, substantial forces acting as jamming forces being possible at the edges of those surfaces. To circumvent these forces, the end faces of the drum comprise additional, straight plunger guides on their insides. This is easily implemented because the plunger moves only in a straight line relative to the drum.

At least one of the outer walls of the drum housing may be appropriately designed to be elastically displaceable outward in order to receive any inelastic trash component and to prevent damage to the equipment.

The receptacle may be in the form of a bag or the like and appropriately is supported in such manner that it can be removed when filled.

To prevent equipment damage in the event of overfilling the receptacle, a measuring instrument may also be provided to ascertain the pressure inside the receptacle and to shut down the equipment when the receptacle is full. This measuring instrument may consist of a bottom plate or the like actuated by a gear means, a limit switch or the like.

A special advantage of the equipment of the invention is that compression and conveyance are related in simple manner. Compaction is implemented by the plunger before arriving at the waste receptacle by usinq, for instance, the plunger to press cans and cardboard flat against the pertinent wall, whereby they can be effortlessly moved into the waste receptacle.

A safety lid should be provided slightly above the outer surface of the drum. A safety switch automatically shuts off the drum drive when the lid is open. During the operation of the invention, the safety lid must be in place.

The equipment of the disclosed embodiment is especially well suited for household use, having a storage capacity of about 12 liters of garbage.

The stationary pin may be supported in an elastic manner so that in the case of increased wall pressure caused by stationary components, the pin can escape in the opposite direction so that the pin is not damaged.

In another preferred embodiment, the pin rests on a torsion bar which is rotated during a escaping motion of the pin and thus constituting a corresponding spring.

DETAILED DESCRIPTION OF THE PREFERRED EMBODIMENT

Figure 1:
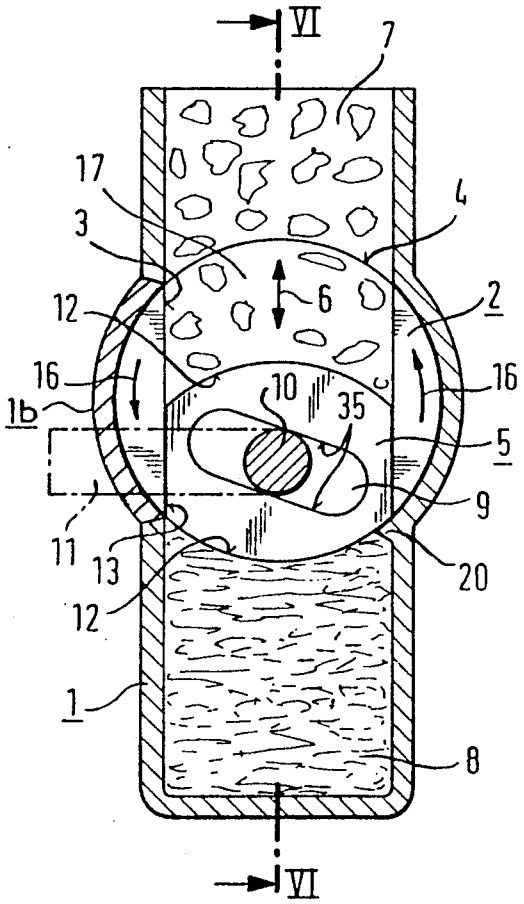
FIGS. 1-are schematic sideviews of the invention.

As shown by FIG. 1, the equipment of the invention consists of a drum 2 rotating in a housing 1 and comprising a shaft 3 passing symmetrically through the drum from its cylindrical outer surfaces 4 and receiving a plunger 5 carrying out a stroke inside the shaft 3 in the direction of the arrow 6 during the rotation of the drum and thereby receiving the wastes to be compacted from a receiving duct 7 and, with simultaneous compaction, conveying these wastes into a lower receptacle s. The motion of the plunger 5 is achieved in that it is provided with a elongated-slot guide 9 entered by a stationary pin 10 which in the embodiment shown is mounted On a stationary support 11 connected to the stationary housing 1.

Figure 4:
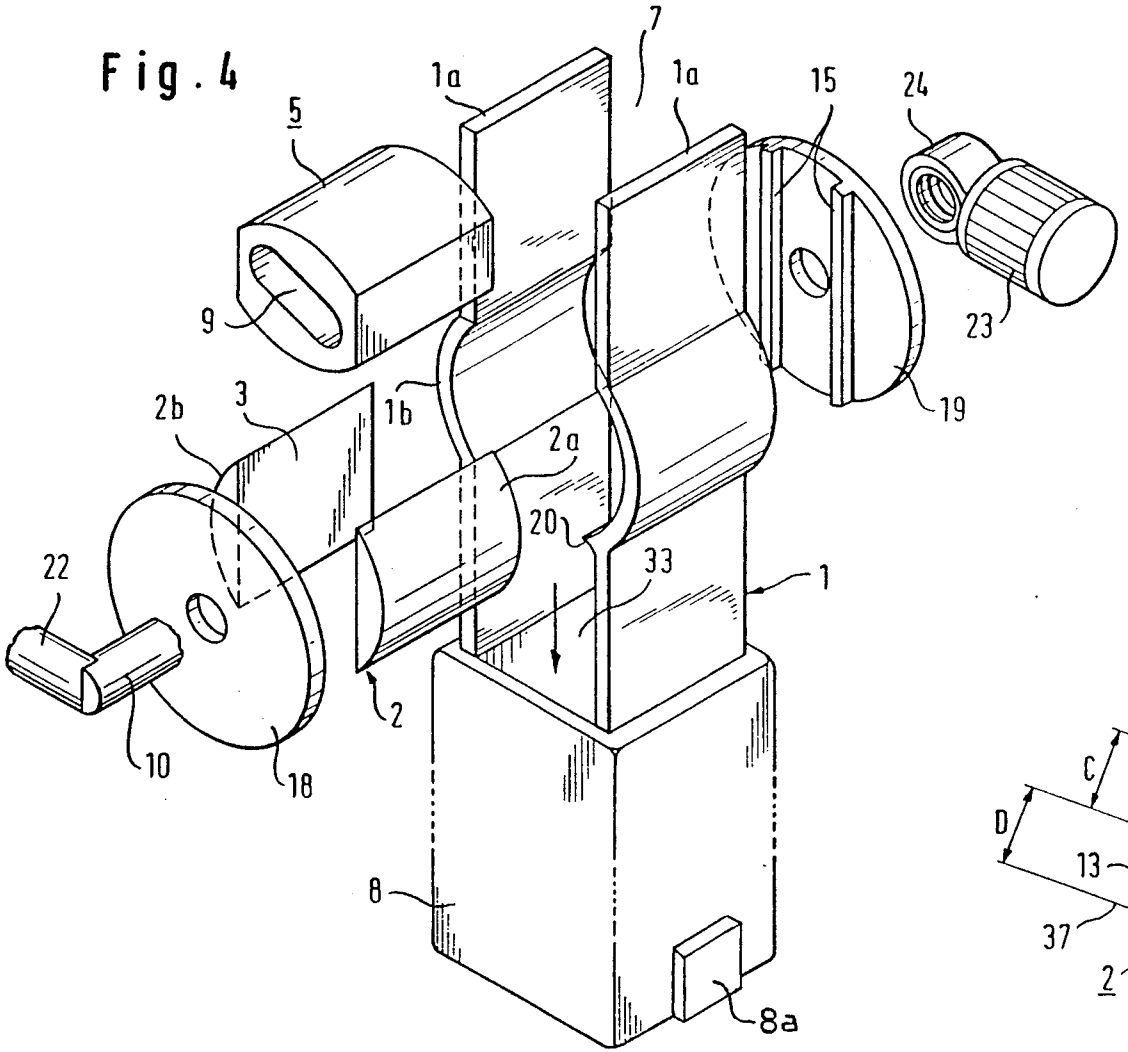
FIG. 4 is an exploded perspective of a preferred embodiment of the equipment of FIGS. 1-3.
Figure 5:
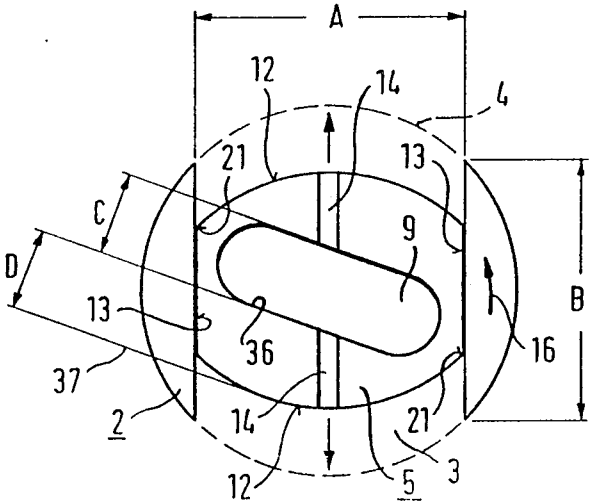
FIG. 5 is a schematic sideview of the drum and plunger.

The peripheral surface of the plunger 5 consists of two mutually opposite partly cylindrical outer surface segments 12 (see also FIG. 5) between which are located two planar outer surface segments 13 (see also FIG. 5). As further shown by FIG. 5, the distance A between the two plane outer-surface segments 13 corresponds to the width of the shaft 3, so that the plunger 5 is guided inside the shaft in the direction of the stroke. This guidance can be reinforced by guide elements such as grooves 14, strips 15 Or the like (see also FIG. 4).

Figure 3:
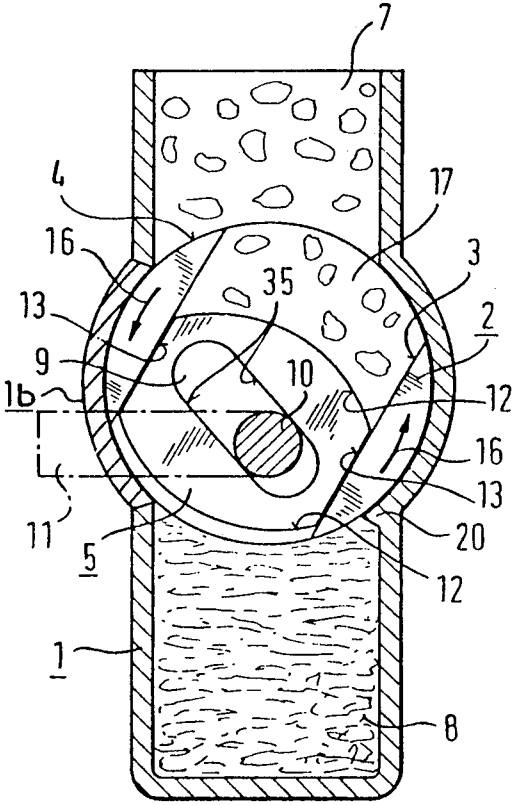
Figure 2:
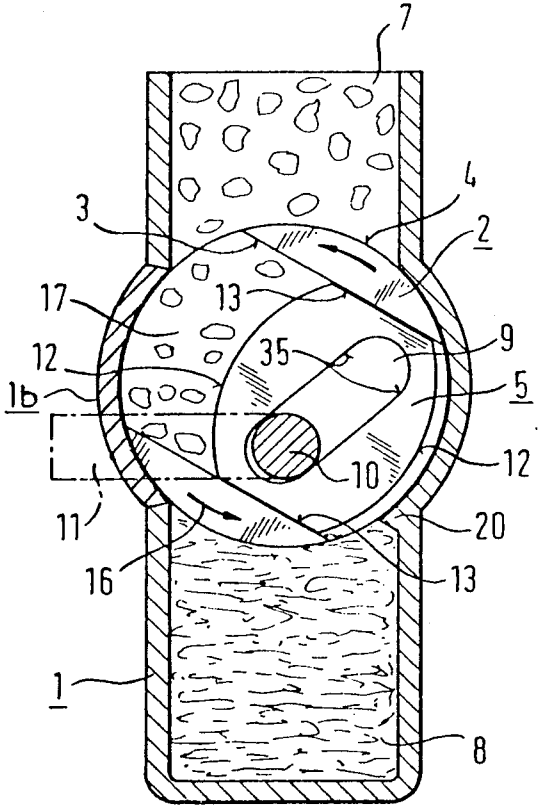

The described equipment operates as follows:

FIG. 1 shows a position of the drum and plunger at rest wherein the upper part of the shaft 3 forms an upwardly open receiving chamber 17. During the drum rotation, the chamber 17 may be filled with trash to be compacted. If the drum 2 rotates clockwise inside the housing 1 in the direction of the arrows 16, the wastes in the receiving chamber 17 are pre-compacted as shown by FIG. 2 because the trash is drawn into the equipment on the left side of FIG. 2. At the same time and as shown by FIG. 3, the plunger is moved by the elongated-slot guide 9 to the outside of the drum (down to the left in FIG. 3), thus compacting the trash further. The final compaction in the receptacle 8 takes place when the plunger and the drum again assume the position of FIG. 1, wherein compaction process is repeated.

FIG. 4 shows a schematically exploded perspective of the invention. As shown by FIG. 4, the shaft 3 in the drum z may consist of two individual parts 2*a* and 2*b* with cylindrical outer walls which can be connected together and to the walls by lids 18 and 19. The housing 1 (see also FIG. 1) is comprised of upper duct segments 1*a* serving to load the trash into the equipment.

To remove any trash remaining from the drum 2, the edge 20 facing the drum (also see FIG. 1) may be designed as a wiper to remove the trash from the drum 2.

Lastly a part 1*b* of the wall around the drum can be designed to be an elastic segment bending outward, whereby jamming by large pieces of trash or the like is averted.

For the same purpose, the stationary pin 10 entering the guide 9 of the drum 5 may be supported on a torsion bar 22 which is rotated when the pin 10 moves out of the way and which forms the corresponding spring. The rotation of pin 10 is accommodated by providing a rearwardly right-angled part 10*a* which is capable of torsional twisting. However, other suitable means may be provided for permitting a limited rotation of pin 10, such as forming the torsion bar 22 of an elastic material.

Furthermore, as shown in FIG. 4, a measuring instrument 8*a* is provided to ascertain the pressure inside the receptacle 8. This feature prevents equipment damage in the event the receptacle 8 is overfilled by shutting down the equipment when the receptacle 8 is full. The measuring instrument 8*a* comprises a bottom plate or the like actuated by gear means, a limit switch or the like.

FIG. 5 makes clear the position and the arrangement of the elongated-slot guide 9 at the corresponding end face of the plunger 5. As shown, the ends of the guide 9 each point —as seen in the direction of rotation 16 —toward the rear connecting edges 21 between the partly cylindrical outer surfaces 12 and the plane outer surfaces 13.

Figure 6:
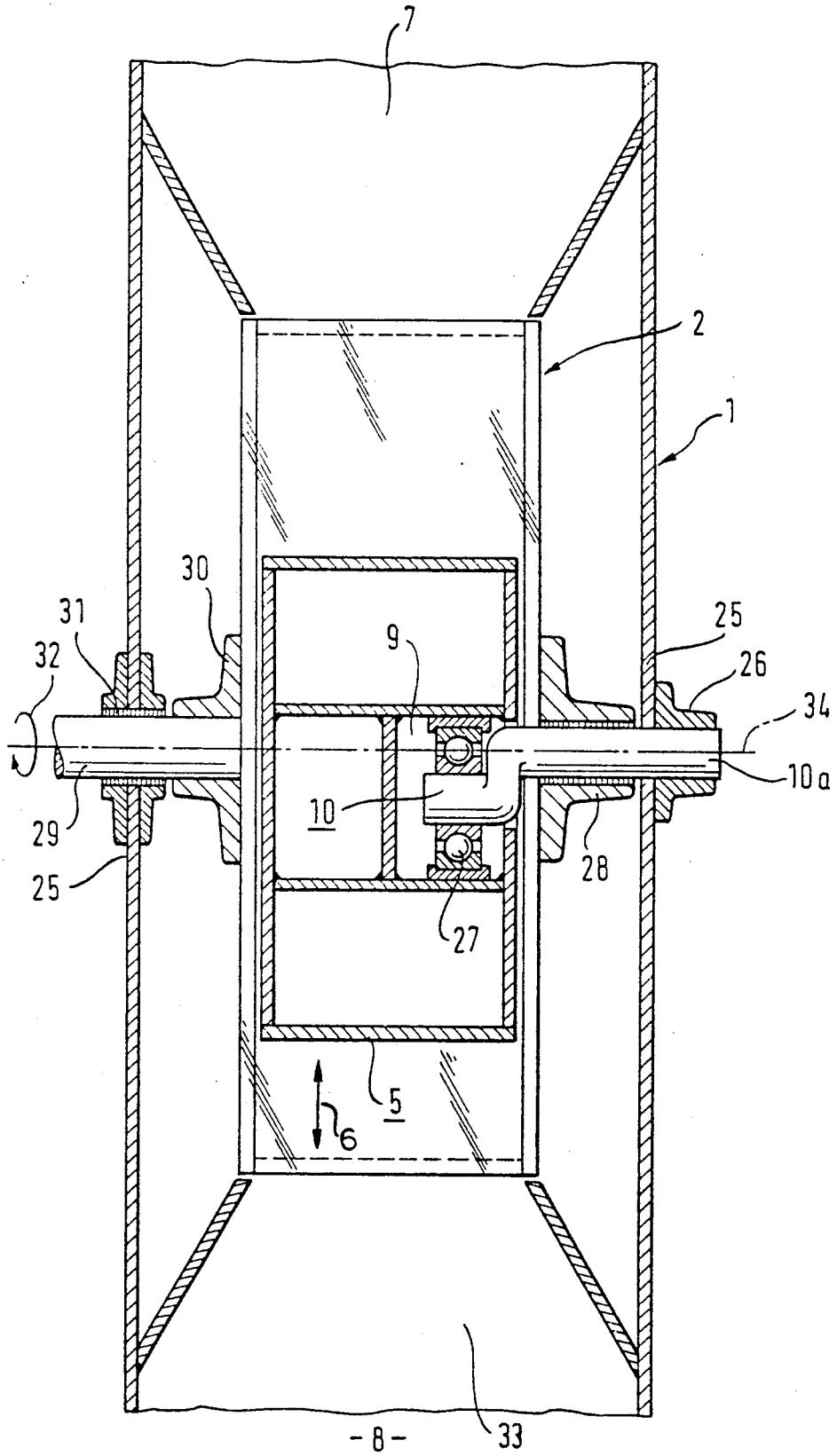
FIG. 6 is a cross-sectional view of the invention taken along line VI—VI of FIG. 1.

FIG. 6 is a cross-section approximately along the line VI—VI in FIG. 1 and serves to clarify the embodiment of this invention.

The pin 10 entering the elongated-slot 9 is mounted in a stationary manner on a part 25 of the housing 1, by a flange 26. In this embodiment a roller bearing 27 forms part of the pin 10 and the elongated-slot guide 9 is of matching dimensions so that the bearing 27 can be seated in the guide 9.

The drum 2 is rotatably supported by means of a flange 28 on the rearwardly right-angled part 10*a* of this pin 10, said rearward part being lined up with a shaft segment 29 connected to the wall of the drum 2 directly or by means of a flange 30. The shaft segment 29 is rotatably supported in the direction of the arrow 32 by a motor 23 with a gearing 24 such as a worm. (see FIG. 4).

The plunger 5 with its elongated-slot guide 9 being guided by the eccentric pin 10, moves to-and-for in the direction of the arrow 6 inside its drum guides when the drum z is rotating, and as a result carries out the above described strokes.

Although particular embodiments of the present invention have been described and illustrated herein, it should be recognized that modifications and variations may readily occur to those skilled in the art, and that such modifications and variations may be made without departing from the spirit and scope of the invention. Consequently, the invention as claimed below may be practiced otherwise than as specifically described below.

What is claimed is:

1. A device for compacting compressible waste, such as paperboard, cardboard, wood wastes, or household trash and the like, comprising:

a housing comprised of an intake duct, a discharge duct, and an intermediate section located between said intake and said discharge duct, said intermediate section having intermediate walls;

a longitudinal direction extending from said intake duct to said discharge duct, a cylindrical drum mounted for rotation about a central axis within said intermediate section;

a means for rotating said drum;

a passageway provided through said drum, said passageway adapted to align with said intake duct and said discharge duct;

a compaction plunger adapted for movement within said passageway and having an elongated slot guide, said slot guide having two opposite flat surfaces and said slot guide is at a slant with respect to said passageway, a stationary pin being eccentrically located relative to the central axis of said drum and positioned to pass within said elongated slot guide and having an axis transverse to said longitudinal direction;

wherein during rotation of said drum, said passageway receives waste from said inlet duct, said plunger compacts said wastes in said passageway against said intermediate walls, and forces said waste out of said passageway as said passageway is rotatably positioned in alignment with said discharge duct.

2. A device for compacting compressible wastes according to claim 1, wherein said intake duct and said discharge duct are adapted to be vertically oriented.

3. A device for compacting compressible wastes according to claim 1, wherein said passageway is comprised of a cross sectionally rectangular shaft, said shaft being symmetrical relative to said drum.

4. A device for compacting compressible wastes according to claim 3, wherein said intake duct and said discharge duct are comprised of cross sectionally rectangular shafts.

5. A device for compacting compressible wastes according to claim 1, wherein said compaction plunger is further comprised of two partly cylindrical, mutually opposite members having inner and outer surfaces, the radii of said outer surfaces corresponding to the overall radius of said drum with the distance between said outer surfaces being less than the diameter of the drum, and said inner surfaces comprising two mutually opposite planar surfaces with the distances between said planar surfaces being less than the diameter of the drum.

6. A device for compacting compressible wastes according to claim 1, wherein said stationary pin has an outer diameter less than the distance between said flat surfaces of said slot guide, said stationary pin being positioned through said slot guide and mounted below a center plane through said drum in a manner offset toward said discharge duct.

7. A device for compacting compressible wastes according to claim 1, wherein said discharge duct communicates with a receptacle.

8. A device for compacting compessible wastes according to claim 7, wherein said receptacle is detachable linked to said discharge duct.

9. A device for compacting compressible wastes according to claim 8, wherein said receptacle is a bag.

10. A device for compacting compressible wastes according to claim 1, wherein a wiper is mounted at an inlet of said discharge duct to wipe the surface of said drum.

11. A device for compacting compressible wastes according to claim 1, wherein said drum is supported between two stationary walls of said intermediate section.

12. A device for compacting compressible wastes according to claim 1, wherein said stationary pin is affixed to at least one of said intermediate walls of said intermediate section.

13. A device for compacting compressible wastes according to claim 1, wherein said stationary pin has a diameter corresponding to the distance between said two opposite flat surfaces of said elongated slot guide, and wherein said stationary pin is slidingly disposed in said elongated slot guide.

14. A device for compacting compressible wastes according to claim 1, wherein said intermediate section comprises a length extending in said longitudinal direction, and each of said intake and discharge ducts comprises a width transverse to said longitudinal direction, wherein said length approximately corresponds to each of said widths.

15. A device for compacting compressible wastes according to claim 14, wherein said intake duct and said discharge duct are rectangular in cross-section.

16. A device for compacting compressible wastes according to claim 1, wherein said drum is further comprised of straight additional guides on side faces of said passageway, wherein said additional guides guide said plunger.

17. A device for compacting compressible wastes according to claim 16, wherein said straight additional guides cooperate with corresponding guides on said plunger.

18. A device for compacting compressible wastes according to claim 1, wherein a portion of at least one intermediate wall of said intermediate section is elastic.

19. A device for compacting compressible wastes according to claim 18, wherein said portion is adapted to elastically bend outward.

20. A device for compacting compressible wastes according to claim 1, further comprised of a measuring instrument to ascertain a pressure inside said receptacle, said measuring instrument adapted to generate a signal when said pressure exceeds a predetermined value.

21. A device for compacting compressible wastes according to claim 20, wherein said predetermined value corresponds to a filled receptacle.

22. A device for compacting compressible wastes according to claim 1, wherein said stationary pin is adapted for limited repositioned movement.

23. A device for compacting compressible wastes according to claim 22, wherein said stationary pin is mounted on a torsion bar, said torsion bar being rotatable during said limited repositioning movement.

24. A device for compacting compressible wastes according to claim 23, wherein said stationary pin further comprises a rearwardly extending portion capable of torsional twisting.

* * * * *